US006089221A

United States Patent [19]

Mano et al.

[11] Patent Number: 6,089,221

[45] Date of Patent: Jul. 18, 2000

[54] SPACE HEATER

[75] Inventors: Hiroshi Mano; Shigeaki Yasui, both of Nagoya, Japan

[73] Assignee: Rinnai Kabushiki Kaisha, Nagoya, Japan

[21] Appl. No.: 09/345,800

[22] Filed: Jul. 2, 1999

[30] Foreign Application Priority Data

Jul. 6, 1998 [JP] Japan ..... 10-190126

[51] Int. Cl.[7] ..... F24H 3/00

[52] U.S. Cl. ..... 126/116 A; 126/110 B; 126/110 C; 236/11; 237/2 A; 237/80

[58] Field of Search ..... 126/116 R, 116 A, 126/110 B, 110 C, 110 R; 236/1 C, 1 H, 10, 11; 237/80, 2 A, 12; 431/75

[56] References Cited

FOREIGN PATENT DOCUMENTS 6-281258 10/1994 Japan .

*Primary Examiner*—Ira S. Lazarus
*Assistant Examiner*—Josiah C. Cocks
*Attorney, Agent, or Firm*—Armstrong, Westerman, Hattori, McLeland & Naughton

[57] ABSTRACT

A space heater for heating air from within a room with a heat exchanger connected to a burner and discharging heated air into the room has a room temperature sensor for detecting a room temperature and a controller for controlling the burner with a freeze prevention temperature set to prevent indoor facilities from being frozen. When the detected room temperature drops to or below the freeze prevention temperature, the controller operates the burner and controls the burner with a lower limit for an amount of heat in the burner with which no moisture condensation occurs in the heat exchanger.

7 Claims, 3 Drawing Sheets

SPACE HEATER

BACKGROUND OF THE INVENTION

1. Field of the Invention

The present invention relates to a space heater, and more particularly to a space heater having a freeze prevention function to prevent indoor facilities from being frozen.

2. Description of the Related Art

Heretofore, there have been known FF type (forced draft direct vent type) space heaters which supply outdoor air as combustion air to a burner (heating means), burn a fuel in the burner, heat a heat exchanger with exhaust gases from the burner, and then discharge the exhaust gases to the outdoor environment.

When such a space heater operates to heat a room, heated air from the heat exchanger heated by the exhaust gases from the burner is circulated in the room by a convention fan to heat the air in the room up to a desired temperature. The space heater has a room temperature sensor (room temperature detecting means) for detecting the temperature of the air in the room, and a room temperature setting means for setting a target room temperature to a desired temperature. The space heater performs a temperature control process for determining an amount of combustion (an amount of heat) in the burner based on the difference between the room temperature detected by the room temperature sensor and a target room temperature set by the room temperature setting means. The temperature control process thus performed prevents the fuel from being combusted by the burner in excess of a determined amount of combustion and hence prevents the room temperature from being unduly increased. Therefore, an undesirably excessive consumption of the fuel by the burner can suppressed, and at the same time a comfortable room temperature can be achieved.

In cold climates where the outdoor temperature is very low, when the space heater is turned off, the indoor temperature tends to drop to such a low level that indoor facilities such as water supply pipes and aquariums may be frozen.

In order to prevent those indoor facilities from frozen, the space heater may be provided with a freeze prevention mode control means for forcibly starting to operate the space heater in a warming mode, i.e., a freeze prevention mode, when the room temperature falls below a freeze temperature for the indoor facilities while the space heater is being turned off or in a timer-controlled standby mode. The room temperature setting means may be operated by the user to set a freeze prevention temperature to any desired temperature.

In the freeze prevention mode, as with the normal warming mode, the temperature control process is carried out to determine an amount of combustion in the burner based on the difference between the room temperature detected by the room temperature sensor and a freeze prevention temperature selected by the user for thereby minimizing the amount of the consumed fuel while preventing the indoor facilities from being frozen.

The freeze prevention temperature that is set in the freeze prevention mode may be a temperature for preventing the indoor facilities from being frozen with a small amount of heat, and is set to a value which is lower than the temperature that is set in the normal warming mode. Since the freeze prevention mode is initiated when the detected room temperature drops below the freeze prevention temperature that is set by the user and thereafter the temperature control process is carried out, the difference between the freeze prevention temperature and the detected room temperature is small. Therefore, the amount of combustion in the burner in the temperature control process is small. When the space heater operates in the freeze prevention mode, the temperature of the heat exchanger itself is often considerably low because the heat exchanger has been cooled to a very low temperature by the air in the room. If the heat exchanger thus cooled is continuously heated by the burner which is controlled for the low amount of combustion, then moisture condensation occurs in the heat exchanger, shortening the service life of the heat exchanger.

SUMMARY OF THE INVENTION

It is therefore an object of the present invention to provide a space heater having a heat exchanger which is prevented from suffering moisture condensation and hence has a relatively long service life.

According to the present invention, there is provided a space heater including a casing, a heat exchanger disposed in the casing and having heating means for heating air, and a fan for drawing air from within a room into the casing and discharging hot air heated by the heating means into the room. The space heater also has room temperature detecting means for detecting a temperature in the room, heating operation control means for controlling operation of the heating means based on the temperature detected by the room temperature detecting means, the heating operation control means having freeze prevention mode control means comprising, freeze prevention temperature setting means for setting a freeze prevention temperature to prevent indoor facilities from being frozen, start control means for starting to operate the heating means when the temperature detected by the room temperature detecting means is equal to or lower than the freeze prevention temperature, and lower-limit amount-of-heat setting means for setting an amount of heat that is greater than an amount of heat with which moisture condensation occurs in the heat exchanger, as a lower limit for an amount of heat in the heating means.

With the above arrangement, no moisture condensation occurs in the heat exchanger, and hence the heat exchanger can maintain a good thermal efficiency. Since the space heater can maintain a room temperature for freeze prevention, indoor facilities are prevented from being frozen efficiently with a small amount of heat.

The heating operation control means may have temperature control means for controlling the amount of heat in the heating means based on the difference between the temperature detected by the room temperature detecting means and the freeze prevention temperature.

Alternatively, the space heater may have room temperature detecting means for detecting a temperature in the room, room temperature setting means for setting a target room temperature, and warming mode control means having temperature control means for determining an amount of heat in the heating means based on the difference between the temperature detected by the room temperature detecting means and the target room temperature set by the room temperature setting means. The space heater may also have freeze prevention mode control means comprising freeze prevention temperature setting means for setting a freeze prevention temperature to prevent indoor facilities from being frozen, control means for operating the heating means when the detected temperature drops below the freeze prevention temperature, and lower-limit amount-of-heat setting means for setting an amount of heat that is greater than an amount of heat with which moisture condensation occurs in the heat exchanger, as a lower limit for the amount of heat. The temperature control means is used to operate the heating means in a freeze prevention mode.

The above arrangement allows manual control means for setting a room temperature and temperature control means of conventional space heaters to be used for controlling the heating means in the freeze prevention mode. When the room temperature drops below a freeze temperature, the space heater controls the heating means in the freeze prevention mode.

Alternatively, the space heater may have warming mode control means having temperature control means for controlling an amount of heat in the heating means which heats the heat exchanger based on the difference between the detected temperature and the target room temperature, freeze prevention temperature setting means for setting a freeze prevention temperature to prevent indoor facilities from being frozen, freeze prevention mode control means for operating the temperature control means with the freeze prevention temperature set as the target room temperature to operate the heating means in a freeze prevention mode if the detected temperature drops below the freeze prevention temperature while the heating means is operated in a warming mode by the warming mode control means, and lower-limit amount-of-heat setting means for setting an amount of heat that is greater than an amount of heat with which moisture condensation occurs in the heat exchanger, as a lower limit for the amount of heat determined by the temperature control means in the freeze prevention mode.

With the above arrangement, the space heater can operate in the normal warming mode for the user to achieve a comfortable room temperature and also in the freeze prevention mode to prevent the indoor facilities from being frozen while the warming mode is off.

Specifically, when the space heater operates in the normal warming mode, the temperature control means determines an amount of heat in the heating means depending on the difference between the target room temperature, e.g., 16° C., and the detected room temperature, and the warming mode control means operates the heating means based on the determined amount of heat.

When the room temperature is lowered while the warming mode is off, if the detected temperature drops below the freeze prevention temperature, e.g., 5° C., the space heater operates in the freeze prevention mode. In the freeze prevention mode, the temperature control means determines an amount of heat in the heating means depending on the difference between the freeze prevention temperature and the detected room temperature, and the freeze prevention mode control means operates the heating means based on the determined amount of heat.

If the heating means continuously heats the heat exchanger with a small amount of heat in the heating means when the heat exchanger itself has a low temperature while the space heater is operating in the freeze prevention mode, then moisture condensation tends to occur in the heat exchanger. According to the present invention, the lower-limit amount-of-heat setting means sets an amount of heat that is greater than an amount of heat with which moisture condensation occurs in the heat exchanger, as a lower limit for the amount of heat determined by the temperature control means in the freeze prevention mode. Therefore, even if the temperature of the heat exchanger itself is low, it can be increased to a temperature at which no moisture condensation occurs in the heat exchanger. Consequently, moisture condensation is reliably prevented from occurring in the heat exchanger, permitting the heat exchanger to have a relatively long service life.

The above and other objects, features, and advantages of the present invention will become apparent from the following description when taken in conjunction with the accompanying drawings which illustrate a preferred embodiment of the present invention by way of example.

DESCRIPTION OF THE PREFERRED EMBODIMENT

Figure 1:
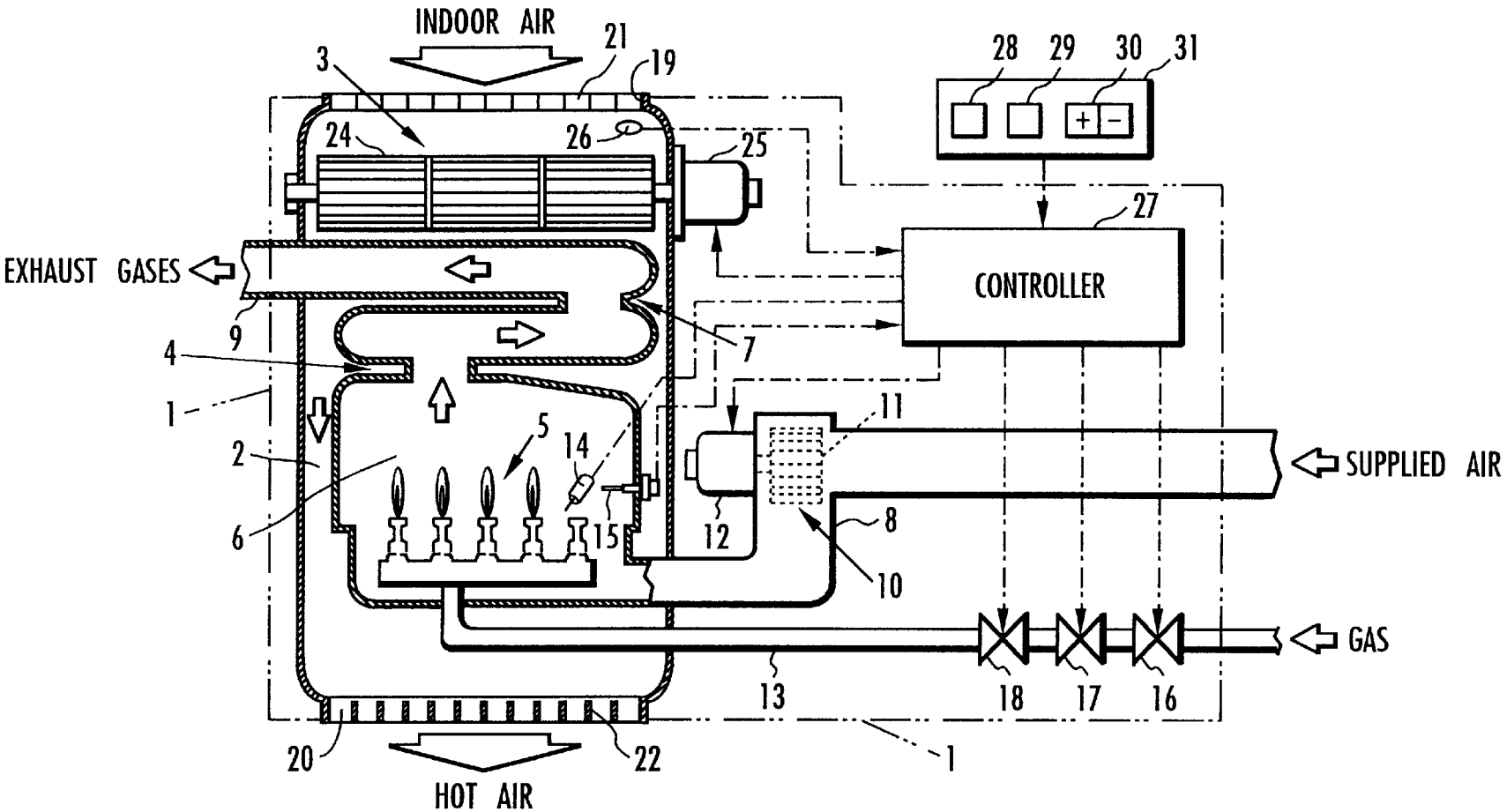
FIG. 1 is a diagram showing a system arrangement of a space heater according to the present invention.

As shown in FIG. 1, a space heater, which may be an FF type gas space heater, for example, has a casing 1 installed in a room, an air passage 2 defined in the casing 1, a fan 3 disposed in the casing 1 for convecting air in the room via the air passage 2, and a combustion unit 4 disposed in the casing 1 for heating the air flowing through the air passage 2.

The combustion unit 4 comprises a burner 5 has a heating means, a combustion chamber 6 accommodating the burner 5 therein, and a heat exchanger 7 connected to the combustion chamber 6. To the combustion chamber 6, there are connected an air supply pipe 8 for supplying combustion air and an exhaust pipe 9 for discharging exhaust gases. The exhaust pipe 9 is connected to the combustion chamber 6 through the heat exchanger 7. The air supply pipe 8 and the exhaust pipe 9 extend out of the casing 1 into the exterior of the room. The air supply pipe 8 houses therein a fan 10 for supplying combustion air to the burner 5 in the combustion chamber 6. The fan 10 comprises a rotary impeller 11 rotatably disposed in the air supply pipe 8 and a fan motor 12 mounted on an outer wall surface of the air supply pipe 8 for rotating the rotary impeller 11. The air supply pipe 8 and the exhaust pipe 9 may be constructed as a coaxial double-walled pipe assembly.

The burner 5 is connected to a gas supply pipe 13 extending from outside the casing 1 into the combustion chamber 6. The burner 5 burns a mixture of a fuel gas supplied thereto from the gas supply pipe 13 and combustion air supplied from the air supply pipe 8 into the combustion chamber 6. An ignition electrode 14 for igniting the mixture and a flame detector 15 such as a flame rod or a thermocouple for detecting a flame produced by the burner 5 are disposed in the combustion chamber 6 in facing relationship to the burner 5.

The gas supply pipe 13 has two solenoid-operated shutoff valves 16, 17 and a proportional gas control valve 18.

The air passage 2 has an air inlet 19 and an air outlet 20 which are defined respectively in rear and front walls of the casing 1, and extends between the air inlet 19 and the air outlet 20 across the heat exchanger 7. An air filter 21 is mounted in the air inlet 19. A louver 22 is mounted in the air outlet 19 for adjusting the direction of hot air discharged from the air outlet 19.

The fan 3 comprises a rotary impeller 24 disposed in the air passage 2 in facing relationship to the air inlet 19, and a fan motor 25 mounted on an outer wall surface of the casing 1 for rotating the rotary impeller 24. When the rotary impeller 24 rotates, the fan 3 draws air in the room via the air inlet 19 into the air passage 2 and forces the drawn air through the air passage 2 across the heat exchanger 7 to the air outlet 20, from which the air is discharged into the room.

A room temperature sensor 26 (room temperature detecting means) for detecting the temperature of the air in the room which is drawn by the fan 3 into the air passage 2, as a room temperature, is disposed in the air passage 2 in facing relationship to the air inlet 19, i.e., between the air inlet 19 and the fan 3.

Figure 2:
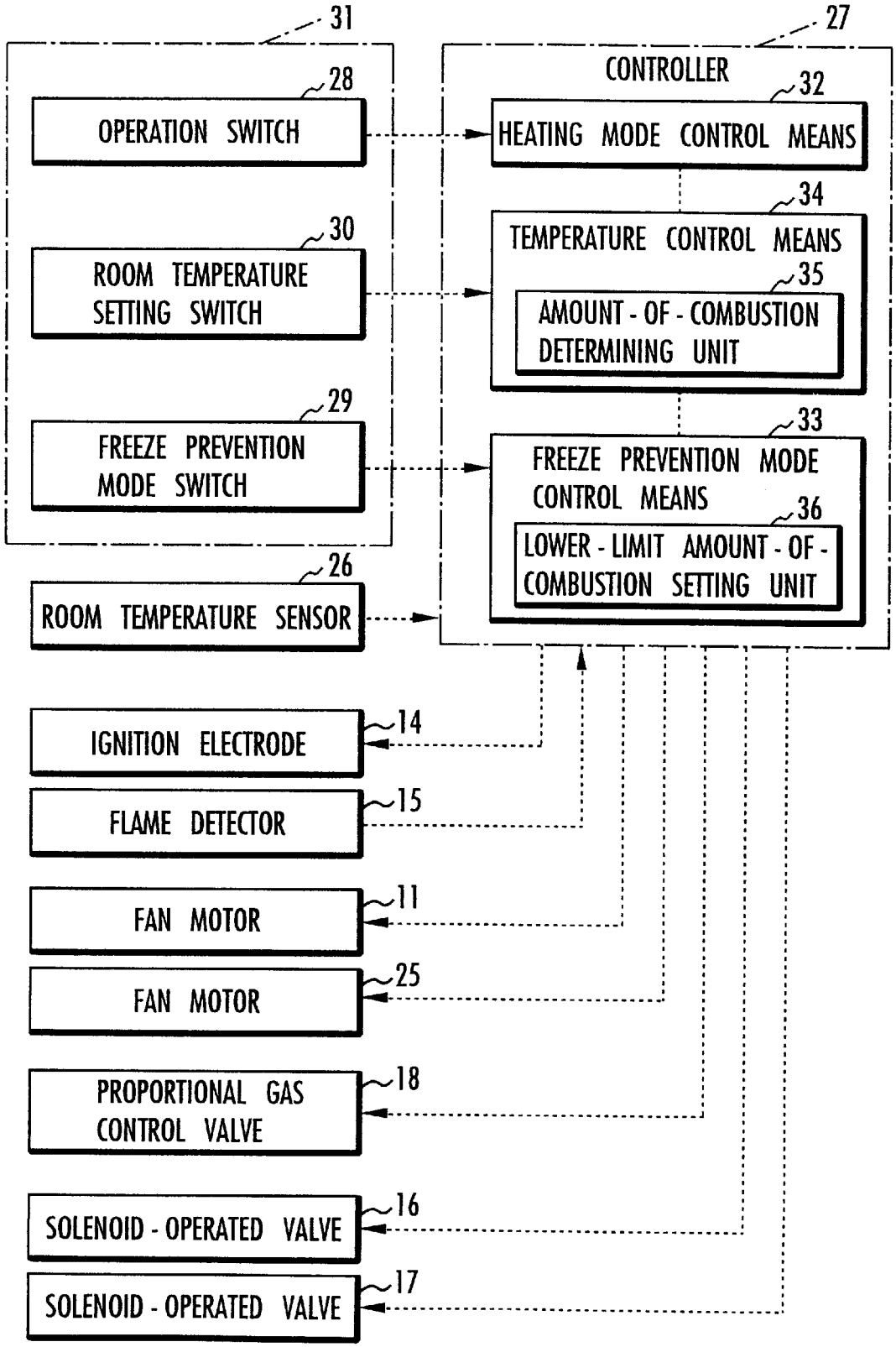
FIG. 2 is a block diagram of a control system of the space heater shown in FIG. 1.

As shown in FIGS. 1 and 2, the space heater also has a controller 27 for controlling its operation with the solenoid-operated shutoff valves 16, 17, the proportional gas control valve 18, the fan motors 12, 25, and the ignition electrode 14, and a manual control panel 31 having an operation switch 28 manually operable by the user to turn on or off the space heater, a freeze prevention mode switch 29 for operating the space heater in a freeze prevention mode, and a room temperature setting switch 30 for setting a target room temperature in a warming mode and a freeze prevention temperature in the freeze prevention mode. The room temperature setting switch 30 serves as a room temperature setting means for setting a desired room temperature in the warming mode when the space heater operates in the warming mode, and as a freeze prevention temperature setting means for setting a freeze prevention temperature in the freeze prevention mode when the space heater operates in the freeze prevention mode. Specifically, in the warming mode, the room temperature can be set to a range from 16° C. to higher temperatures by the room temperature setting switch 30, and in the freeze prevention mode, the room temperature can be set to a range from 5° C. to 15° C. by the room temperature setting switch 30. Therefore, the room temperature range in the freeze prevention mode is lower than the room temperature range in the warming mode. A room temperature that is set in the freeze prevention mode is different from a comfortable room temperature, but may be a minimum temperature required to prevent indoor facilities such as water supply pipes and aquariums from being frozen.

As shown in FIG. 2, the controller 27 has a heating operation control means as a main functional component which comprises a warming mode control means 32, a freeze prevention mode control means 33, and a temperature control means 34.

The temperature control means 34 has an amount-of-combustion determining unit 35 for determining an amount of combustion (an amount of heat) in the burner 5 based on the difference between a target room temperature set by the room temperature setting switch 30 and the room temperature detected by the room temperature sensor 26.

The warming mode control means 32 controls the operation of the space heater in the warming mode based on the amount of combustion determined by the amount-of-combustion determining unit 35 when the operation switch 28 is operated by the user to turn on the space heater. Specifically, the amount-of-combustion determining unit 35 determines, from time to time, a required amount of combustion in the burner 5 depending on the room temperature detected by the room temperature sensor 26 and the room temperature set by the room temperature setting switch 30 in the warming mode. The warming mode control means 32 controls the amount of the fuel gas to be supplied to the burner 5 and the amount of the combustion air to be supplied to the burner 5 respectively with the proportional gas control valve 18 and the fan motor 12 in order for the burner 5 to burn the air-gas mixture to achieve the determined required amount of combustion, and also controls the fan motor 25 in order for the fan 3 to supply an amount of air commensurate with the required amount of combustion, for thereby operating the space heater for room temperature control.

As with the warming mode control means 32, the freeze prevention mode control means 33 controls the amount of the fuel gas to be supplied to the burner 5 and the amount of the combustion air to be supplied to the burner 5 respectively with the proportional gas control valve 18 and the fan motor 12 in order for the burner 5 to burn the air-gas mixture to achieve the required amount of combustion determined by the amount-of-combustion determining unit 35, and also controls the fan motor 25 in order for the fan 3 to supply an amount of air commensurate with the required amount of combustion. At this time, the amount-of-combustion determining unit 35 determines, from time to time, a required amount of combustion in the burner 5 depending on the difference between the room temperature detected by the room temperature sensor 26 and the room temperature (freeze prevention temperature) set by the room temperature setting switch 30 in the freeze prevention mode.

The freeze prevention mode control means 33 has a lower-limit amount-of-combustion setting unit 36 (lower-limit amount-of-heat setting means) for setting a lower limit for the amount of combustion determined by the amount-of-combustion determining unit 35. The lower limit for the amount of combustion will be described below. When an air temperature outside of the room is excessively low, since the room temperature is also excessively low, the heat exchanger 7 itself is cooled by the cold air in the room. In the freeze prevention mode, the difference between the room temperature detected by the room temperature sensor 26 and the freeze prevention temperature set by the room temperature setting switch 30 is often very small, and hence the required amount of combustion determined by the amount-of-combustion determining unit 35 is low. If the combustion in the burner 5 is continued under such a condition, then moisture condensation occurs in the heat exchanger 7 which has been cooled by the cold air in the room. For this reason, the lower-limit amount-of-combustion setting unit 36 sets an amount of heat that is greater than the amount of heat with which moisture condensation occurs in the heat exchanger 7, as a lower limit for the amount of combustion.

Operation of the space heater will be described below. First, basic operation of the space heater in the warming mode will be described with reference to FIGS. 1 and 2. It is assumed that in the warming mode, a desired target room temperature has been set by the user with the room temperature setting switch 30. When the user turns on the operation switch 28, it sends an operation start command to the controller 27, which operates the fan 10, energizes the ignition electrode 14 to produce a spark discharge for a certain period of time, opens the solenoid-operated shutoff valves 16, 17 and the proportional gas control valve 18 to start supplying a certain amount of fuel gas to the burner 5 for thereby igniting the fuel gas in the burner 5. The controller 27 confirms the ignition the fuel gas in the burner 5 with the flame detector 15.

After the fuel gas is ignited in the burner 5, the controller 27 controls the fan motor 25 to start operating the fan 3. Air in the room is drawn via the air inlet 19 into the air passage 2. As the drawn air flows through the air passage 2 toward the air outlet 20, it is heated by the heat exchanger 7 which is heated by the combustion in the burner 5, and then discharged as hot air from the air outlet 20 into the room.

When the combustion in the burner 5 and the operation of the fan 3 begin, the temperature control means 34 determines an amount of combustion in the burner 5 based on the difference between the room temperature detected by the room temperature sensor 26 and the target room temperature, and the warming mode control means 32 controls the combustion in the burner 5 and the amount of air supplied by the fan 3 for room temperature control. Basically, as the room temperature detected by the room temperature sensor 26 approaches the target room temperature, the warming mode control means 32 reduces the amount of combustion in the burner 5 and lowers the rotational speed of the fan 3 to reduce the amount of hot air discharged from the air outlet 20. When the room temperature detected by the room temperature sensor 26 becomes lower than the target room temperature due to a change in the target room temperature, for example, the warming mode control means 32 increases the amount of combustion in the burner 5 and increases the rotational speed of the fan 3 to increase the amount of hot air discharged from the air outlet 20. Thereafter, if the user turns off the operation switch 28, the operation of the space heater in the warming mode is stopped.

The space heater according to the present invention also can operate in the freeze prevention mode to prevent the indoor facilities such as water supply pipes and aquariums from being frozen when the room temperature excessively falls while the warming mode is off.

Figure 3:
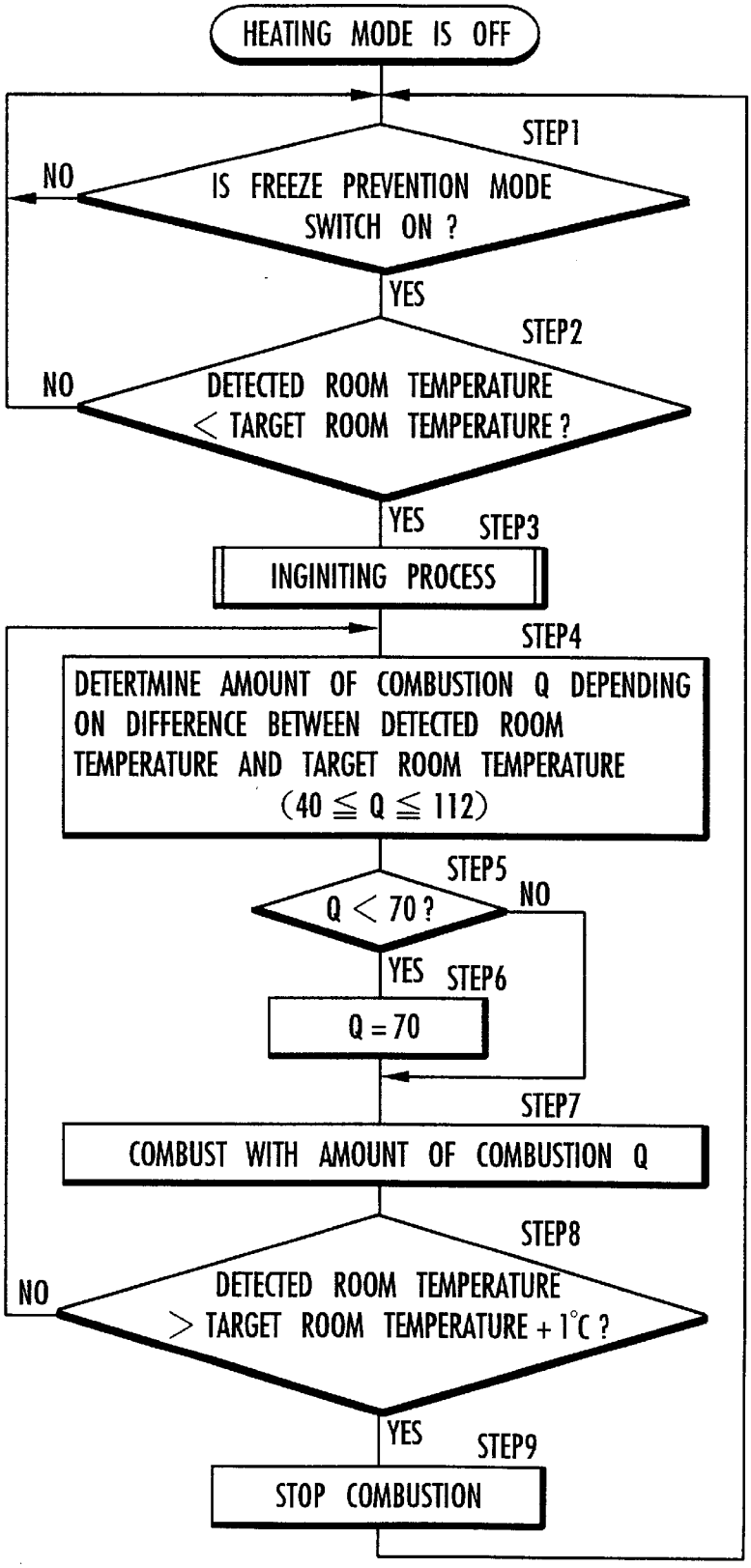
FIG. 3 is a flowchart of an operation sequence of a freeze prevention mode carried out by the control system shown in FIG. 2.

Operation of the space heater in the freeze prevention mode will be described below with reference to FIG. 3. It is assumed that in the freeze prevention mode, a freeze prevention temperature has been set as a desired target room temperature by the user with the room temperature setting switch 30. While the warming mode is off, if the user turns on the freeze prevention mode switch 29 (YES in STEP1) and also if the room temperature detected by the room temperature sensor 26 is lower than the target room temperature (YES in STEP2), then the freeze prevention mode control means 33 operates to sends an operation start command to the controller 27. In STEP3, the controller 27 operates the fan 10, energizes the ignition electrode 14 to produce a spark discharge for a certain period of time, opens the solenoid-operated shutoff valves 16, 17 and the proportional gas control valve 18 to start supplying a certain amount of fuel gas to the burner 5 for thereby igniting the fuel gas in the burner 5. Thereafter, the controller 27 controls the fan motor 25 to start operating the fan 3 for thereby discharging hot air from the air outlet 20 into the room.

In STEP4, the temperature control means 34 determines an amount of combustion Q in the burner 5 depending on the room temperature detected by the room temperature sensor 26 and the target room temperature. Thereafter, control proceeds to STEP5. The amount of combustion Q determined by the amount-of-combustion determining unit 35 of the temperature control means 34 on the basis of the difference between the detected room temperature and the target room temperature is of any value in a range from 40 kcal/min. (weak combustion) to 112 kcal/min. (strong combustion). The inventor of the present invention has found from various tests that if the amount of combustion Q is lower than 70 kcal/min., then moisture condensation occurs in the heat exchanger 7. Therefore, the lower-limit amount-of-combustion setting unit 36 of the freeze prevention mode control means 33 sets the lower limit for the amount of combustion to 70 kcal/min.

In STEP5 and STEP6, the lower-limit amount-of-combustion setting unit 36 operates. Specifically, in STEP5, if the amount of combustion Q determined by the amount-of-combustion determining unit 35 is lower than 70 kcal/min. (YES in STEP5), then the lower-limit amount-of-combustion setting unit 36 forcibly sets the lower limit for the amount of combustion to 70 kcal/min. in STEP6. Then, control goes to STEP7 in which the fuel gas is burned by the burner 5 to achieve the amount of combustion Q as set to 70 kcal/min. If the amount of combustion Q determined by the amount-of-combustion determining unit 35 is not lower than 70 kcal/min. (NO in STEP5), then control jumps from STEP5 to STEP7. In STEP7, the fuel gas is burned by the burner 5 to achieve the amount of combustion Q as determined in STEP4.

The temperature control operation in STEP4 through STEP7 is carried out unless the detected room temperature exceeds a temperature which is the sum of the target room temperature and 1° C. (NO in STEP8). If the detected room temperature exceeds the temperature which is the sum of the target room temperature and 1° C. (YES in STEP8), then control goes to STEP9 in which the combustion in the burner 5 is stopped. The operation of the space heater in the freeze prevention mode is now finished.

In the illustrated embodiment, the lower limit for the amount of combustion is set to 70 kcal/min. by the lower-limit amount-of-combustion setting unit 36. It is preferable that the lower limit for the amount of combustion be a minimum amount of combustion required to prevent moisture condensation from occurring in the heat exchanger 7. Therefore, the lower limit for the amount of combustion may be increased or reduced depending on the shape and size of the heat exchanger 7 or the ability of the burner 5.

In the illustrated embodiment, the space heater has been described as an FF type gas space heater for introducing combustion air from outside the room and discharging exhaust gases out of the room with the fan 10. However, the space heater may comprise an FF type (forced draft vent type) space heater for introducing combustion air from within the room and discharging exhaust gases out of the room, or a CF type (natural draft vent type) space heater for introducing combustion air from within the room and discharging exhaust gases out of the room through an exhaust pipe by a natural draft. Furthermore, the principles of the present invention are also applicable to a space heater which uses a liquid fuel rather than a gas fuel. The control process in the freeze prevention mode according to the present invention is also applicable to any space heater having a heat exchanger even though its heat source is not based on fuel combustion.

Although a certain preferred embodiment of the present invention has been shown and described in detail, it should be understood that various changes and modifications may be made therein without departing from the scope of the appended claims.

What is claimed is:

1. A space heater comprising:

a casing;

a heat exchanger disposed in said casing and having heating means for heating air;

a fan for drawing air from within a room into said casing and discharging hot air heated by said heating means into the room;

room temperature detecting means for detecting a temperature in the room; and heating operation control means for controlling operation of said heating means based on the temperature detected by said room temperature detecting means;

said heating operation control means having freeze prevention mode control means comprising:

freeze prevention temperature setting means for setting a freeze prevention temperature to prevent indoor facilities from being frozen;

start control means for starting to operate said heating means when the temperature detected by said room temperature detecting means is equal to or lower than said freeze prevention temperature; and lower-limit amount-of-heat setting means for setting an amount of heat that is greater than an amount of heat with which moisture condensation occurs in said heat exchanger, as a lower limit for an amount of heat in said heating means.

2. A space heater according to claim 1, wherein said heating operation control means comprises temperature control means for controlling the amount of heat in said heating means based on the difference between the temperature detected by said room temperature detecting means and said freeze prevention temperature.

3. A space heater according to claim 1, wherein said casing has a passage defined therein for drawing air therethrough into said casing, said room temperature detecting means being disposed in said passage.

4. A space heater according to claim 1, wherein said heating operation control means comprises warming mode control means having room temperature setting means for setting a target room temperature, and temperature control means for controlling the amount of heat in said heating means based on the difference between the temperature detected by said room temperature detecting means and said target room temperature.

5. A space heater according to claim 4, further comprising:

manual control means for manually controlling said room temperature setting means to control said freeze prevention temperature setting means, said freeze prevention mode control means comprising means for operating the heating means in a freeze prevention mode based on the amount of heat controlled by said temperature control means based on the difference between said freeze prevention temperature and said target room temperature.

6. A space heater according to claim 4, wherein said heating operation control means comprises manual control means for operating said freeze prevention mode control means when said warming mode control means is turned off.

7. A space heater comprising:

a casing;

a heat exchanger disposed in said casing and having heating means for heating air;

a fan for drawing air from within a room into said casing and discharging hot air heated by said heating means into the room;

room temperature detecting means for detecting a temperature in the room;

room temperature setting means for setting a target room temperature;

temperature control means for determining an amount of heat in said heating means based on the difference between the temperature detected by said room temperature detecting means and the target room temperature set by said room temperature setting means;

warming operation control means for controlling said heating means based on the amount of heat determined by said temperature control means;

freeze prevention temperature setting means for setting a freeze prevention temperature to prevent indoor facilities whose temperatures are lower than said target room temperature from being frozen;

freeze prevention mode control means for operating said temperature control means with the freeze prevention temperature set as the target room temperature to operate said heating means in a freeze prevention mode based on the amount of heat determined by said temperature control means if the temperature detected by said room temperature detecting means is equal to or lower than the freeze prevention temperature set by said freeze prevention temperature setting means; and lower-limit amount-of-heat setting means for setting an amount of heat that is greater than an amount of heat with which moisture condensation occurs in said heat exchanger, as a lower limit for the amount of heat determined by said temperature control means in said freeze prevention mode.

* * * * *